United States Patent [19]

Zeidler

[11] 4,193,016

[45] Mar. 11, 1980

[54] ELECTRON GUN SHIELD CUP PROVIDING TUBE EVACUATION BYPASS VENTS

[75] Inventor: H. Rudolf Zeidler, Highland Park, Ill.

[73] Assignee: Zenith Radio Corporation, Glenview, Ill.

[21] Appl. No.: 839,461

[22] Filed: Oct. 4, 1977

[51] Int. Cl.[2] ..... H01J 1/96

[52] U.S. Cl. ..... 313/449; 313/451; 313/412; 313/481

[58] Field of Search ..... 313/414, 412, 413, 448, 313/449, 402, 481, 383, 378, 390, 451, 456, 417

[56] References Cited

U.S. PATENT DOCUMENTS

| | | | |
|---|---|---|---|
| 3,524,096 | 8/1970 | Kuryla et al. | 313/404 |
| 3,573,533 | 4/1971 | Gronlund | 313/456 X |
| 3,931,540 | 1/1976 | Kawamura | 313/404 |
| 3,961,220 | 6/1976 | Say | 313/417 |
| 3,987,328 | 10/1976 | Yoshida et al. | 313/414 |

*Primary Examiner*—Robert Segal
*Assistant Examiner*—Darwin R. Hostetter
*Attorney, Agent, or Firm*—Ralph E. Clarke, Jr.

[57] ABSTRACT

This disclosure depicts for use in a television picture tube having a bulb with a neck at the rear end thereof, a novel electron gun located in closely confined relationship in the neck. The gun has at least one cathode having an electron emissive coating, an apertured, substantially diamond-shaped shield cup with truncated corners and a plurality of electrodes interspaced between the cathode and the shield cup. The tube is characterized by the shield cup having one or more inward formations at one or more spaced locations around its periphery. The inward formations of the shield cup function to define one or more openings between the shield cup and the inner wall of the neck which act as cathode-erosion-suppressing by-pass vents during tube evacuation, and/or provide augmented deflection space for contact springs attached to selected opposite ones of said corners.

4 Claims, 6 Drawing Figures

ELECTRON GUN SHIELD CUP PROVIDING TUBE EVACUATION BYPASS VENTS

CROSS REFERENCE TO RELATED APPLICATION

This application relates to, but is in no way dependent upon, copending applications of common ownership herewith, including: Ser. No. 782,140, filed Mar. 28, 1977, now U.S. Pat. No. 4,132,459, issued Jan. 2, 1979 Ser. No. 784,478, filed Mar. 31, 1977, now U.S. Pat. No. 4,137,480, issued Jan. 30, 1979 and Ser. No. 642,049, filed Dec. 18, 1975, now U.S. Pat. No. 4,032,811, issued June 28, 1977.

BACKGROUND OF THE INVENTION AND DISCLOSURE STATEMENT

This invention relates in general to the manufacture of color television picture tubes and in particular to an apparatus for suppressing erosion of the electron emissive coating on the cathode of an electron gun during manufacture of the tube. Conventionally, an electron gun used in a color television picture tube includes an electron beam source and an electron beam focus lens. The electron beam source typically comprises a heated cathode element and associated electrodes which collect electrons emitted by the cathode element and form them into a beam cross-over. The electron beam focus lens shapes the stream of electrons emitted by the cathode and focuses the beam cross-over on the screen of the tube. The electron beam focus lens typically comprises electrodes at varying potentials. The forward element is the focus lens anode and typically takes the form of a cup called a "convergence" or "shield" cup.

An electron gun for use in a color television picture tube generally comprises three guns, one each for exciting red, blue and gree phosphor elements on the screen of the tube. Each of the electrodes and the shield cup in the gun have three apertures, one for each of the three cathodes which emit the streams of electrons. The apertures are generally circular and the apertures for each beam lie on a common line, that is they are coaxial. The apertures in the electron gun form beam passageways.

In the manufacture of color television picture tubes or black and white tubes, after the tube is assembled, most of the gas, usually air, which is inside the tube must be evacuated. Conventionally, this is done by attaching a vacuum pump to a tubulator which is located at the rear of the neck of the tube. As the tube is evacuated, all of the gas which is drawn from the tube must move through the neck of the tube and thus through the electron gun situated in the tube neck. The beam passageways through the gun unavoidably act as high velocity gas conduits as the tube is evacuated. These high velocity gas conduits create a violent flow of gas over the cathodes while the tube is being evacuated. It has been observed that this violent flow of gas over the cathode causes erosion of the electron emissive coating on the cathode (especially the coating of the "green" cathode in an electron gun for a color television picture tube) which may necessitate rejection of a tube or which may result in degraded performance and/or reliability of a tube.

It is common practice in the manufacture of television picture tubes to control the humidity during evacuation of the tube within a narrow dew point window. Typically the dew point is controlled between 40° F. to 50° F. If the humidity is too high the cathode coating is eroded by particles of moisture during evacuation. This, coupled with the high velocity at the initiation of evacuation and the violent flow of the air through the electron gun in the neck of the tube results in serious erosion of the cathode coating. The narrow dew point window has always presented serious problems in the manufacture of color television picture tubes. The conventional factory process must be constantly and closely monitored and the dew point window shifted with the seasons of the year. The present process is so difficult as to be barely workable. Suppression of the cathode erosion would allow the dew point window to be opened up, and thus allow the same process to be used year around.

Copending application Ser. No. 782,140 now U.S. Pat. No. 4,132,459 discloses a method of preventing cathode coating erosion wherein gas is pumped slowly from the tube so that the flow of gas through the electron gun does not occur at such a high reate as to cause erosion of the cathode coatings. This method has several drawbacks: (1) an undesirably lone time is needed to evacuate the tube, and (2) also the method is not totally reliable.

Copending application Ser. No. 784,478 now U.S. Pat. No. 4,137,480 discloses a unique electron gun having at least one cathode having an electron emissive coating, a forward element and a plurality of electrodes interspaced between the cathode and the forward element. The electrodes and forward element each have at least one aperture wherein the apertures in the electrodes and forward element are coaxial and define at least one beam passageway for passing through the gun a stream of electrons emitted by the cathode during operation. The beam passageway unavoidably forms a conduit for high velocity gas when the gun is located in a narrow neck of a television picture tube and the tube is evacuated of gas through a tubulator located at the rear end of the neck. The improvement in the electron gun comprises a gas influencing element for perturbing the high velocity as flow in the conduit at least in the region of the cathode as the tube is evacuated to suppress erosion of the cathode coating by preventing a violent flow of gas over the cathode.

British Pat. No. 1474-714 discloses the use of a protective coating over the electron emissive coating on the cathode for protection against water droplets during evacuation of the tube. After the tube is evacuated the protective coating is heated and an activated oxide cathode results.

This invention has general applicability and may be applied to electron gun assemblies in color television picture tubes as well as to electron guns in black and white tubes. The invention is known to have applicability to a television picture tube having a narrow neck utilizing either a standard type electron gun or a unique type of electron gun disclosed in U.S. Pat. No. 3,995,194, assigned to the assignee of this invention.

OBJECTS OF THE INVENTION

It is a general object of the present invention to provide an improved electron gun for a television picture tube.

It is a more specific object of the present invention to provide an electron gun for a television picture tube, the gun having in a preferred embodiment, a low cost dual purpose provision which is effective to provide an augmented deflection space for each of three or more control springs attached thereto and to suppress erosion of cathode coatings in the gun during its manufacture by preventing a violent flow of gas over the cathodes as the tube is evacuated.

It is thus another object of the present invention to provide an electron gun for a television picture tube which increases the yield reliability, and/or performance of the containing tube.

BRIEF DESCRIPTION OF THE DRAWINGS

The features of the present invention which are believed to be novel are set forth with particularity in the appended claims. The invention together with further objects and advantages thereof may best be understood by reference to the following description, taken in conjunction with the accompanying drawings in the several figures of which like reference numerals identify like elements, and in which:

DESCRIPTION OF THE PREFERRED EMBODIMENT

This invention pertains to an apparatus for suppressing erosion of the electron emissive coatings of the cathodes of an electron gun used in a television picture tube as well as providing an augmented deflection space for contact springs. The erosion is suppressed by preventing a violent flow of gas over the cathodes during evacuation of the tube during its manufacture.

Figure 1:
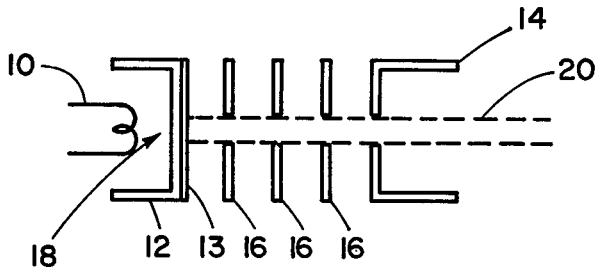
FIG. 1 is a schematic representation of an electron gun.
Figure 2:
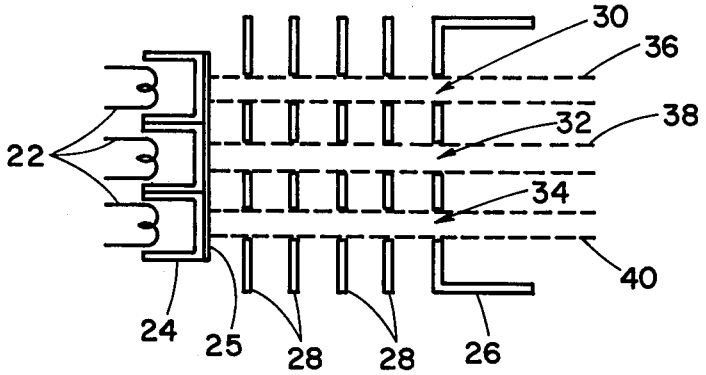
FIG. 2 is a schematic representation of an electron gun assembly used in a color television picture tube, the assembly comprising three distinct electron guns.

FIG. 1 schematically depicts a typical electron gun used in a television picture tube. The electron gun comprises at least one heater 10 and cathode 12, the cathode 12 having an electron emissive coating 13, and a forward element, such as a convergence or shield cup 14, with several electrodes 16 interspaced between the cathode 12 and the shield cup 14. The electrodes 16 and the shield cup 14 each have at least one aperture 18. These apertures 18 in the electrodes 16 and shield cup 14 are coaxial and define a beam passageway 20 for passing through the gun a stream of electrons emitted by the cathode 12 during operation of the tube. In an electron gun assembly for a color television picture tube (schematically depicted in FIG. 2), there are in actuality three electron guns. The electron gun assembly has three heaters 22 and cathodes 24, the cathodes 24 having electron emissive coatings 25, a shield cup 26 and a plurality of electrodes 28 interspaced between the three cathodes 24 and the shield cup 26. Each of the electrodes 28 and the shield cup 26 have three apertures 30, 32, 34. Arbitrarily, these apertures can be denoted first (30), second (32), and third (34) apertures which correspond to the red, blue and green electron guns. The apertures 30, 32, 34 in the electrodes 28 and shield cup 26 are coaxial and define three beam passageways 36, 38, 40 for passing through the gun assembly streams of electrons emitted by the three cathodes 24 during operation of the tube.

Figure 3:
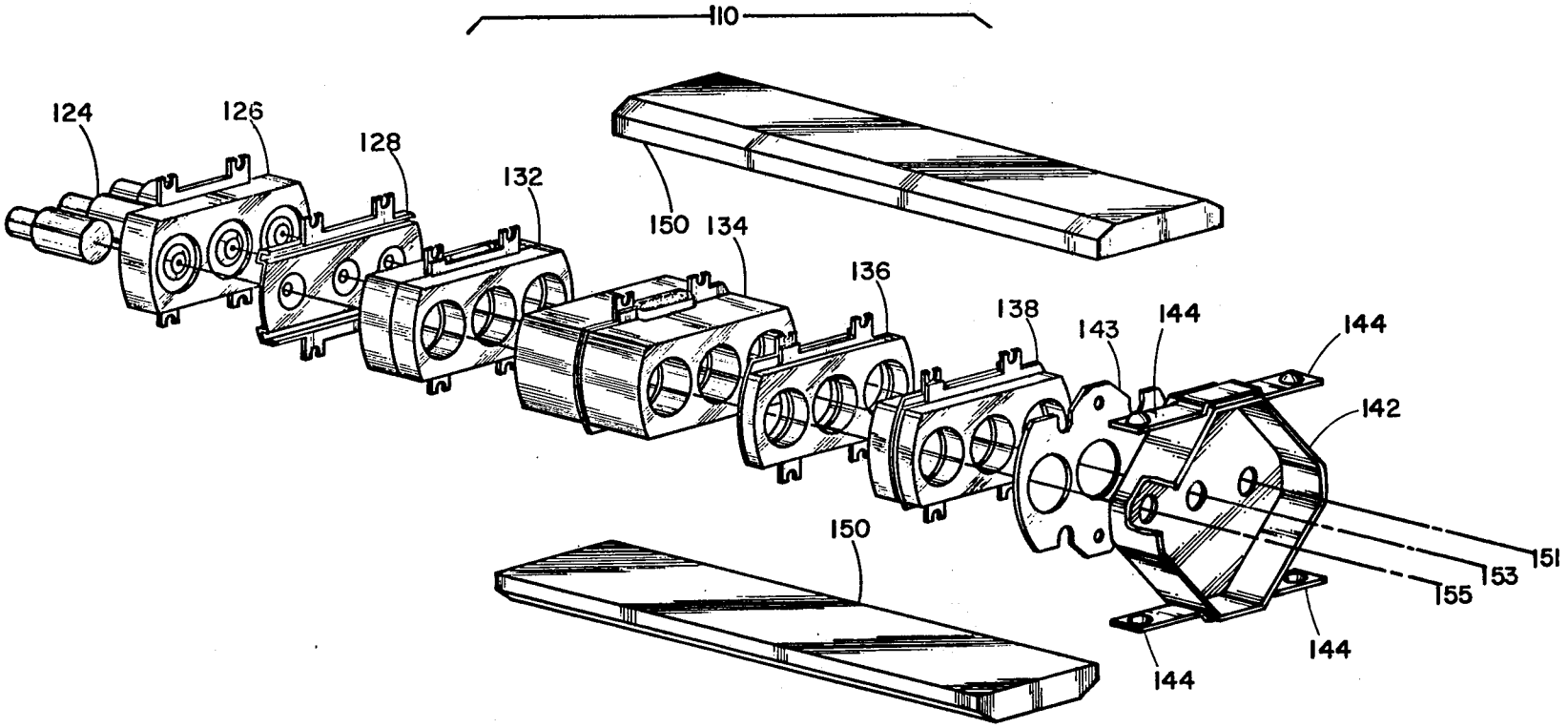
FIG. 3 is a perspective view of an in-line type electron gun for use in a color television picture tube.

More specifically, FIG. 3 shows an in-line type gun, generating three coplanar electron beams each of which is formed, shaped and directed to selectively energize phosphor elements located on the imaging screen in the expanded area at the opposite end of the cathode ray tube envelope (not shown).

The gun 110 has a tetrode section which generates three separate beam cross-overs (not shown), one for each of three beams 151, 153 and 155 (red-associated, blue-associated and green-associated). The tetrode section is comprised of four parts: separate cathodes 124 for each beam, a common control elecrode 126 ("G1"), a common disc-type accelerating electrode 128 ("G2"), and a part of a common electrode 132 ("G3"); that is, the "lower end", or the end nearest the cathode.

Beam cross-overs are imaged on the screen of the cathode ray tube by respective main focus lens means. The main focus lens means for the three beams 151, 153 and 155 are unitized and constituted by the upper end section of common main focus electrode 132 and common main focus electrodes 134, 136 and 138. Each of these electrodes 132, 134, 136 and 138 is electrically isolated from the others and receives predetermined voltages from a power supply to form a single extended main focusing field. The collection of unitized common main focus electrodes 132, 134, 136 and 138 are termed the "main focus lens" of the gun 110. The main focus lens means is described and claimed in U.S. Pat. No. 3,995,194. The term "main focus lens means" refers to the focus lens structures employed to focus a single beam. The term "main focus electrode means" refers to a discrete individual focus electrode for a single beam, or an allotted portion of a unitized electrode common to other beams.

Further with reference to FIG. 3, the last in the series of elements that comprise electron beam gun 110 is shield cup 142. Shield cup 142 provides a mounting base for four contact springs 144 which center the forward end of the gun in the neck of the cathode ray tube. Also, by contact with an electrically conductive coating on the inside of the neck of the tube, which is maintained at screen voltage, contact springs 144 convey the screen voltage through shield cup 142 to electrode 138 of the main focus lens. Located within the cavity formed by the shield cup 142, and adjacent to the apertures from which the three electron beams 151, 153 and 155 emerge, are enhancer and shunt magnetic devices. Shield cup 142 is aligned and bonded to electrode 138 in precise registration by means of a carrier plate 143 which lies between the cup and electrode. In the unitized in-line gun described in this disclosure, the common electrodes 126, 128, 132, 134, 136 and 138 have on each side thereof at least one pair of widely spaced, relatively narrow claws embedded at widely spaced points in a wide beam 150 (described and claimed in copending application Ser. No. 642,049, filed Dec. 18, 1975, now U.S. Pat. No. 4,032,811).

As noted, except for the three cathodes 124, the individual electrodes for "unitized"; that is, they each comprise one mechanical assembly having individual apertures for the three coplanar beams 151, 153 and 155. The gun electrodes are further characterized by having three effectively continuous, electrically shielding beam passageways extending completely through the electrodes, each passageway being formed by a contiguous axial succession of the deep-drawn annular lips.

Figure 4:
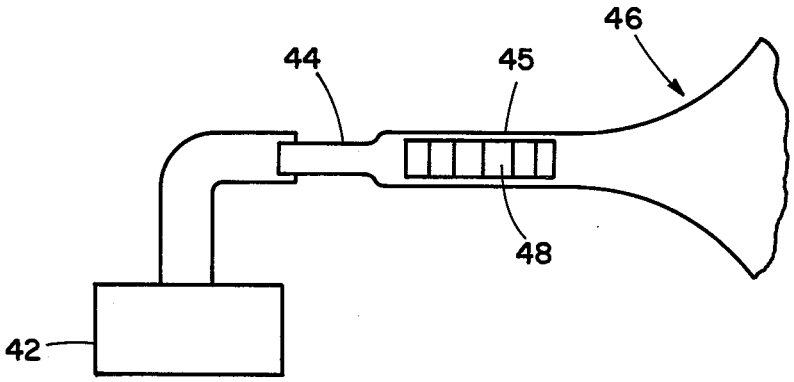
FIG. 4 is a schematic representation of the standard method of evacuating a television picture tube during manufacture.

The coaxial apertures in the electrodes and shield cup form beam passageways, and these beam passageways unavoidably form conduits for high velocity gas when the tube, especially a tube having a narrow neck, is evacuated during manufacture. During the manufacture of television picture tubes, after the tube is assembled, it is necessary to evacuate the tube of most air or gas which is in the tube (see FIG. 4). This is typically done by attaching a vacuum pump 42 to a tubulator 44 which is attached to a rear end of the neck 45 of a tube 46. When the tube 46 is evacuated, an electron gun 48 is already in position within the neck 45 of the tube 46. As the vacuum pump 42 removes the gas from the tube 46, the beam passageways in the gun 48 unavoidably form conduits for high velocity gas. Since the cathodes of the electron gun are necessarily positioned on the axis of the coaxial apertures of the gun, these beam passageways create a violent flow of gas over the cathodes.

It has been observed that during evacuation of the tube, the electron emissive coatings on the cathodes of the electron gun have been eroded. It is well known that the cathode coatings are sensitive to humidity in the atmosphere during evacuation of the tube and it is common practice to control the humidity within a narrow dew point window during evacuation. Typically the dew point is controlled between 40° F to 50° F. If the humidity is too high the cathode coating may be eroded by particles of moisture condensing on the cathode during evacuation. This, coupled with their high velocity during evacuation in the violent flow of gas through the narrow neck of the tube, results in serious erosion of the cathode coatings. This theory has been tested by injecting particles of carbon into the tube before evacuation. After the tube was evacuated, carbon particles were observed on the cathode coatings of the electron gun and thus it is believed that the above theory is correct, and that particles of moisture due to the drop in pressure within the tube and due to the violent flow of gas over the cathodes cause erosion of the cathode coatings. By the present invention, erosion of the cathode coatings is suppressed by preventing a violent flow of gas over the cathodes.

Figure 5A:
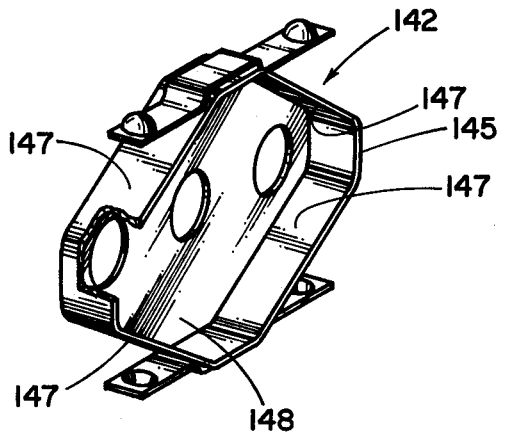
FIGS. 5A and 5B are schematic representations depicting an embodiment of the present invention.
Figure 5B:
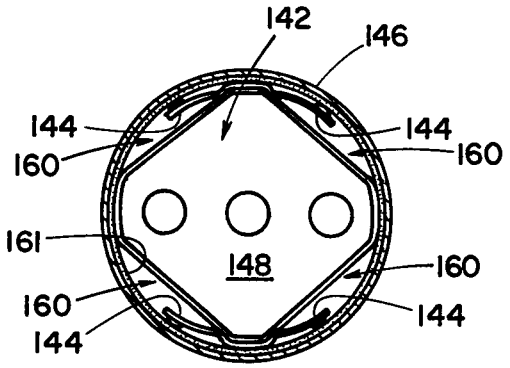

FIGS. 5A and 5B illustrate a preferred embodiment of the present invention. A shield cup 142 has a side wall 145 extending from a bottom wall 148. Four dual-purpose inward formations 147 through the axial length of the shield cup 142 cause the bottom wall 148 of the shield cup 142 to have a substantially diamond shape configuration with truncated corners. The inward formation 147 adjacent each contact spring 144 provides an augmented deflection space or opening 160 for each spring 144. The four tangentially oriented contact springs 144 are attached to selected opposite ones of said corners for positioning the electron gun within the neck 146 of the tube and for establishing electrical connection with the conductive coating 161 on the internal surface of the front portion of the neck and the internal surface of the funnel. The four contact springs 144 are located in the plane of the shield cup 142 and are capable of being deflected in a radially inward direction. The arrangement of the four contact springs 144 cause the electron gun assembly to be self-centering with the tube neck.

The inward formations 147 corresponding to the flats on the diamond shaped cup each further act in cooperation with the inner wall of the neck 146 to define an opening 160 which acts as a by-pass vent through which exhausted gases are caused to substantially by-pass the beam conduit 20 (see FIG. 1) in the electron gun, thereby reducing the high velocity gas flow in the conduit 20 at least in the region of the cathode 12 as the tube is evacuated to suppress erosion of the cathode coating 13 by preventing a violent flow of gas over the cathode 12.

The invention is not limited to the particular details of construction of the device depicted and other modifications and applications are contemplated. Certain other changes may be made in the above-described device without departing from the true spirit and scope of the invention herein involved. It is intended therefore that the subject matter in the above depiction shall be interpreted as illustrative and not in a limiting sense.

What is claimed is:

1. In a television picture tube having a bulb with a neck at the rear end thereof, an electron gun located in closely confined relationship in said neck, said gun having at least one cathode having an electron-emissive coating, apertured substantially diamond-shaped shield cup with truncated corners having one or more tangentially directed contact springs attached to selected opposite ones of said corners, said springs being located in the plane of said shield cup and being capable of being deflected in a radially inward direction, said gun further including a plurality of electrodes interspaced between said cathode and said shield cup nad having apertures in alignment with said cathode and with said apertures in said shield cup to form coaxial beam passageways, said tube being characterized by said shield cup having one or more inward formations corresponding to the flats on the said diamond shape and located adjacent to said contact springs for providing augmented deflection space for said springs and for defining one or more openings between said shield cup and the inner wall of said neck, said openings acting as vents to bypass a flow of high-velocity gas around said gun and away from said aperture to prevent said beam passageways from forming said conduits for said exhaust gas during tube evacuation whereby damage to said electron-emissive coating from said high-velocity gas is prevented.

2. An electron gun having at least one cathode having an electron emissive coating, a substantially diamond-shaped shield cup with truncated corners and a plurality of electrodes interspaced between said cathode and said shield cup, said shield cup having three or more tangentially directed contact springs attached to selected opposite ones of said corners said spring being located in the plane of said shield cup and being capable of being deflected in a radially inward direction, said electrodes and shield cup each having at least one aperture, said apertures in said electrodes and shield cup being coaxial and defining at least one electron beam passageway for passing through said gun a stream of electrons emitted by said cathode during tube operation, said beam passageway unavoidably forming a potential conduit for high velocity gas, said gun being characterized by said shield cup having a dual purpose inward formation located adjacent each contact spring to provide an augmented deflection space for said spring, said inward formations throughout the axial length of said shield cup each further acting in cooperation with an inner wall of a neck of a tube in which said electron gun may be installed to define an opening which acts as a by-pass vent through which exhausted gases are caused to substantially by-pass vent through which exhausted gases are caused to substantially by-pass said beam conduit in said electron gun when said tube is evacuated during its fabrication, thereby reducing the gas flow in said conduit at least in the region of said cathode as said tube is evacuated to suppress erosion of said cathode coating by preventing a violent flow of gas over said cathode.

3. In a television picture tube having a bulb having a faceplate and a funnel with a neck at the rear end of the funnel, said funnel and the front portion of said neck having a conductive coating on their internal surfaces, an electron gun located in closely confined relationship in said neck, said gun having at least one cathode having an electron emissive coating, a substantially diamond-shaped shield cup with truncated corners and a plurality of electrodes interspaced between said cathode and said shield cup, said shield cup having three or more tangentially oriented contact springs attached to selected opposite ones of said corners for positioning said gun within said neck and for establishing electrical connection with said conductive coatings, said three or more contact springs being located in the plane of said shield cup and being capable of being deflected in a radially inward direction, said electrodes and shield cup each having at least one aperture wherein said apertures in said electrodes and shield cup are coaxial and define at least one electron beam passageway for passing through said gun a stream of electrons emitted by said cathode during tube operation, said beam passageway unavoidably forming a potential conduit for high velocity gas when said tube is evacuated of gas during its fabrication through a tubulator located at the rear end of said neck, said tube being characterized by said shield cup having a dual purpose inward formation located adjacent each contact spring to provide an augmented deflection space for said spring, said inward formations throughout the axial length of said shield cup each further acting in cooperation with the inner wall of said neck to define an opening which acts as a by-pass vent through which exhausted gases are caused to substantially by-pass said beam conduit in said electron gun, thereby reducing the high velocity gas flow in said conduit at least in the region of said cathode as said tube is evacuated to suppress erosion of said cathode coating by preventing a violent flow of gas over said cathode.

4. In a television picture tube having a bulb having a faceplate and a funnel with a neck at the rear end of the funnel, said funnel and the front portion of said neck having a conductive coating on their internal surfaces, an electron gun located in closely confined relationship in said neck, said gun having at least one cathode having an electron emissive coating, a substantially diamond-shaped shield cup having truncated corners and a plurality of electrodes interspaced between said cathode and said shield cup, said shield cup having four tangentially oriented contact springs attached to selected opposite ones of said corners for positioning said gun within said neck and for establishing electrical connection with said conductive coating, each of said four contact springs being located in the plane of said shield cup and capable of being deflected in a radially inward direction, said electrodes and shield cup each having at least one aperture wherein said apertures in said electrodes and shield cup are coaxial and define at least one electron beam passageway for passing through said gun a stream of electrons emitted by said cathode during tube operation, said beam passageway unavoidably forming a potential conduit for high velocity gas when said tube is evacuated of gas during its fabrication through a tubulator at the rear end of said neck, said tube being characterized by said shield cup having a dual purpose inward formation located adjacent each contact spring to provide an augmented deflection space for said spring, said inward formations throughout the axial length of said shield cup each further acting in cooperation with the inner wall of said neck to define an opening which acts as a by-pass vent through which exhausted gases are caused to substantially by-pass said beam conduit in said electron gun, thereby reducing the high velocity gas flow in said conduit at least in the region of said cathode as said tube is evacuated to suppress erosion of said cathode coating by preventing a violent flow of gas over said cathode.

* * * * *